US010151525B2

(12) United States Patent
Shrader et al.

(10) Patent No.: US 10,151,525 B2
(45) Date of Patent: Dec. 11, 2018

(54) HARVEST BIN ASSEMBLY

(71) Applicant: Electrolux Home Products, Inc., Charlotte, NC (US)

(72) Inventors: Benjamin Paul Shrader, Charlotte, NC (US); Israel Mercer Neto, Curitiba (BR); Brent Aaron Curtis, Terrell, NC (US); Cristhian Serrano Camacho, Curitiba (BR); Ramom Eduardo Gadens Baduy, Curitiba (BR)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/880,777

(22) Filed: Jan. 26, 2018

(65) Prior Publication Data

US 2018/0149410 A1 May 31, 2018

Related U.S. Application Data

(63) Continuation of application No. 15/335,706, filed on Oct. 27, 2016, now Pat. No. 9,903,641.

(51) Int. Cl.
*F25D 23/04* (2006.01)
*F25D 25/00* (2006.01)
(Continued)

(52) U.S. Cl.
CPC ..... *F25D 23/04* (2013.01); *F25D 11/02* (2013.01); *F25D 25/005* (2013.01); *F25D 25/025* (2013.01)

(58) Field of Classification Search
CPC ..... F25D 23/02; F25D 23/028; F25D 23/04; F25D 11/02
See application file for complete search history.

(56) References Cited

U.S. PATENT DOCUMENTS 4,186,978 A 2/1980 Thomson
6,126,257 A 10/2000 Carpenter
(Continued)

FOREIGN PATENT DOCUMENTS

EP 1724539 11/2006
EP 2594876 5/2013
(Continued)

OTHER PUBLICATIONS

International Search Report for PCT/US2017/058658 dated Mar. 8, 2018, 3 pages.

*Primary Examiner* — Hanh V Tran
(74) *Attorney, Agent, or Firm* — Pearne & Gordon LLP

(57) ABSTRACT

A refrigerator appliance includes a compartment and a door having an interior wall and at least one rail attached thereto. A harvest bin assembly is attachable to the at least one rail and includes a housing having a mount for securing the housing to the at least one rail. First pivot elements are disposed on each side of the housing. A removable bin defines a storage space and includes a plurality of holes formed in a bottom wall thereof. Second pivot elements are disposed on a side wall of the removable bin and engage a corresponding first pivot element on the housing. The first pivot elements and the second pivot elements define a pivot axis whereby the removable bin pivots between a first, closed position and a second, open position. A tray engages the bottom wall of the removable bin when the removable bin is in the first, closed position.

18 Claims, 9 Drawing Sheets

(51) Int. Cl.
*F25D 11/02* (2006.01)
*F25D 25/02* (2006.01)

(56) References Cited

U.S. PATENT DOCUMENTS

| | | | |
|---|---|---|---|
| 6,173,580 | B1 | 1/2001 | Rosenburg |
| 7,472,974 | B2 | 1/2009 | Czach et al. |
| 8,864,252 | B1 | 10/2014 | Rodriguez |
| 9,400,132 | B2 | 7/2016 | Shrader |
| 2003/0020386 | A1 | 1/2003 | Leimkuehler |
| 2006/0082270 | A1 | 4/2006 | Collins |
| 2006/0250063 | A1 | 11/2006 | Czach |
| 2007/0113578 | A1 | 5/2007 | Wu |
| 2010/0270902 | A1 | 10/2010 | Kim |
| 2013/0119846 | A1 | 5/2013 | Seo et al. |
| 2014/0312758 | A1 | 10/2014 | Gossens et al. |
| 2014/0360220 | A1 | 12/2014 | Rackley |
| 2016/0290706 | A1 | 10/2016 | Rackely et al. |
| 2016/0341468 | A1 | 11/2016 | Joo |
| 2017/0367478 | A1 | 12/2017 | Ahmedov et al. |

FOREIGN PATENT DOCUMENTS

| | | |
|---|---|---|
| KR | 20090132284 | 12/2009 |
| WO | 9808036 | 2/1998 |
| WO | 2012106316 | 8/2012 |

HARVEST BIN ASSEMBLY

FIELD OF THE INVENTION

This application relates generally to a refrigerator storage module, and more particularly, to a refrigerator having a harvest bin assembly for storing food items wherein the harvest bin assembly may be positioned at various locations on a door of the refrigerator.

BACKGROUND OF THE INVENTION

The inside portion of a refrigerator generally includes organizational and storage elements, for example shelves built into an interior wall of a fresh-food or freezer compartment, for example the interior of a refrigerator door. Shelves enable a user to organize and store items, such as food and/or beverages, within the refrigerator, for example by providing a storage bin.

Conventionally, a user will rinse or clean some food items with water, such as fruits and vegetables, place these items in a bag or other container and then store the items in one of the aforementioned shelves of the refrigerator. Residual water may remain on the food items if the food items are not completed dry when placed in the refrigerator, and may pool at the bottom of the bag or other container. This residual water may be undesirable for some fruits and vegetables, when stored immersed, as it may lead to premature ripening. Moreover, after washing, the user often places the food items in a new bag or container. Using a new bag or container requires that the user purchase additional bags or containers simply for short term storage of the food items.

Accordingly, there is a need for a storage module that allows a user to easily rinse and store food items within a refrigerator.

BRIEF SUMMARY OF THE INVENTION

In accordance with one aspect, a refrigerator appliance includes a compartment within the refrigeration appliance for storing food items in a refrigerated environment. A door is attached to the refrigeration appliance and is movable between an open position for allowing access to the compartment and a closed position for sealing the compartment. The door includes an interior wall. At least one rail is attached to the interior wall of the door and extends in a generally horizontal direction along the door. A harvest bin assembly is attachable to the at least one rail. The harvest bin assembly is provided for storing food items therein and includes a housing. The housing includes a mount for securing the housing to the at least one rail wherein the housing is slidable along the at least one rail. A first pivot element is disposed on each side of the housing. A removable bin includes a front wall, a back wall, opposing side walls and a bottom wall defining a storage space. A plurality of holes is formed in the bottom wall for allowing water to pass therethrough but hindering the food items from passing therethrough. A second pivot element is disposed on each side wall of the removable bin wherein each second pivot element engages a corresponding first pivot element on the housing when the removable bin is positioned within the housing, wherein the first pivot elements and the second pivot elements define a pivot axis whereby the removable bin is pivotable between a first, closed position and a second, open position relative to the housing. A tray has an opening formed in a top thereof wherein the tray engages the bottom wall of the removable bin and the opening of the tray is in registry with the plurality of holes in the removable bin when the removable bin is in the first, closed position.

In accordance with yet another aspect, a refrigerator appliance has a storage bin assembly attachable within a fresh food compartment of the refrigerator appliance. The storage bin assembly is provided for storing food items therein and includes a housing having a mount for securing the housing to a rail in the fresh food compartment wherein the housing is slidable along the rail. A first pivot element is on each side of the housing. At least one guide element is on at least one side wall of the housing. A removable bin has a front wall, a back wall, opposing side walls and a bottom wall defining a storage space. A plurality of holes is formed in the bottom wall for allowing water to pass therethrough but hindering the food items from passing therethrough. A second pivot element is on each opposing side wall of the removable bin wherein each second pivot element engages a corresponding first pivot element on the housing when the removable bin is positioned within the housing. At least one corresponding guide element is on at least one of the opposing side walls of the removable bin. The first pivot elements and the second pivot elements define a pivot axis whereby the removable bin pivots between a first, closed position and a second, open position relative to the housing. One of the at least one guide element on the housing or the at least one corresponding guide element on the removable bin is a curved channel and the other of the at least one guide element on the housing or the at least one corresponding guide element on the removable bin is a guide pin dimensioned to slide within the curved channel. The at least one guide element on the housing and the at least one corresponding guide element on the removable bin engage each other for guiding the removable bin as the removable bin pivots between the first, closed position and the second, open position. A tray has an opening formed in a top thereof wherein the tray engages the bottom wall of the removable bin. The opening of the tray is in registry with the plurality of holes of the removable bin when the removable bin is in the first, closed position.

BRIEF DESCRIPTION OF THE DRAWINGS

Preferred embodiments are disclosed and described in detail herein with reference to the accompanying drawings which form a part hereof, and wherein.

DESCRIPTION OF EXAMPLE EMBODIMENT

Figure 1:
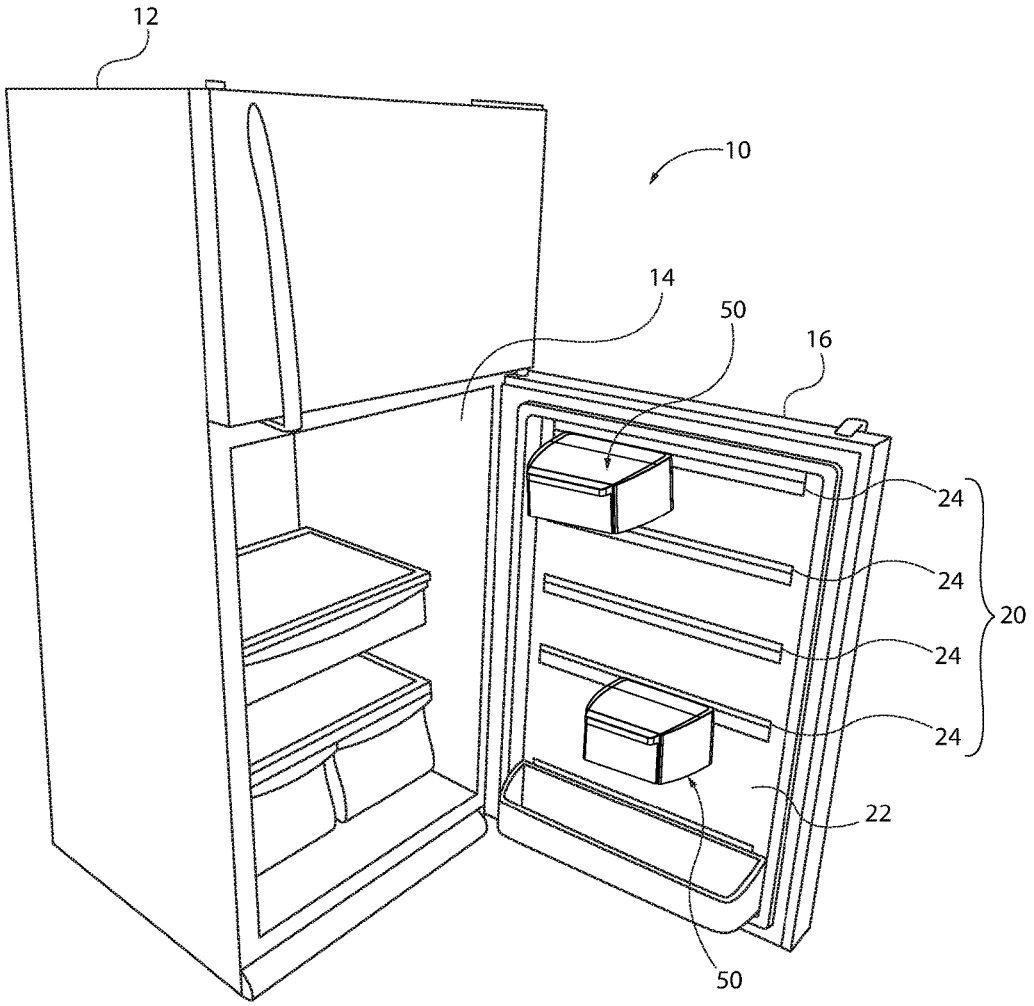
FIG. 1 is a perspective view of the inner portion of the fresh-food compartment of a top mount refrigerator including several harvest bin assemblies removably and slidably attached to a rail on a door of the refrigerator.
Figure 2:
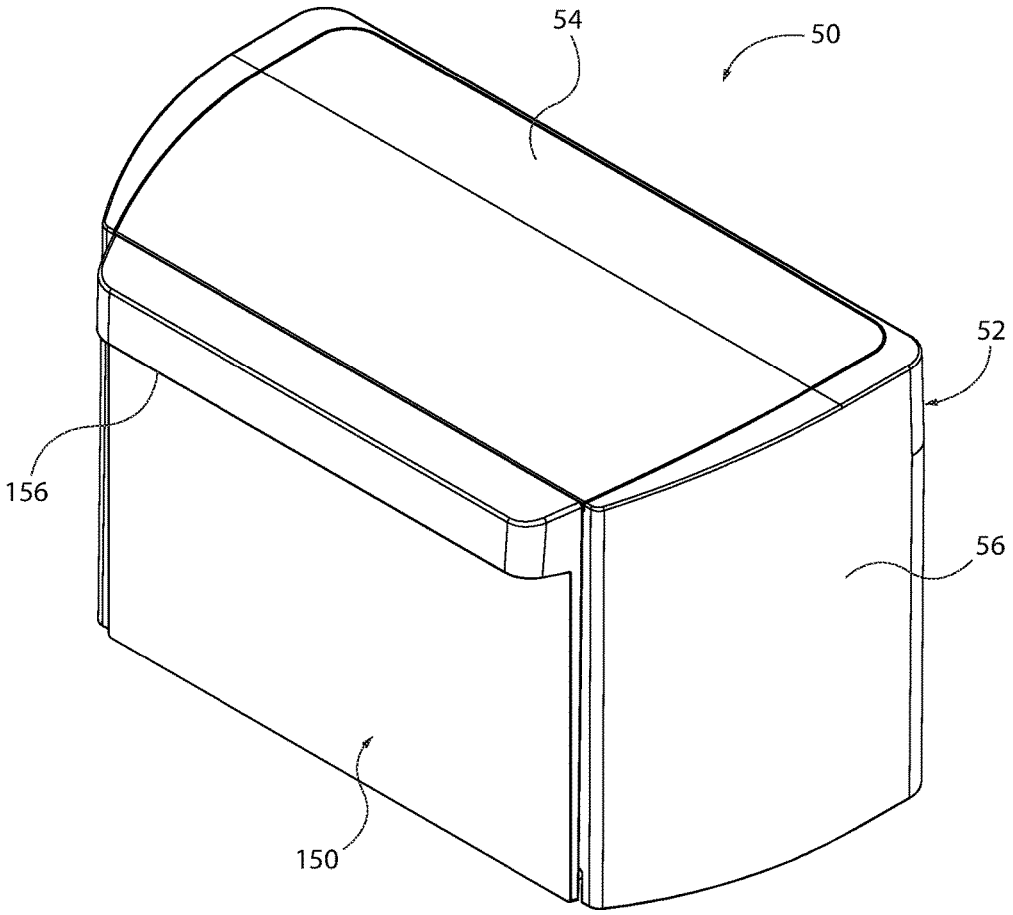
FIG. 2 is a front perspective view of an example harvest bin assembly.

Referring now to FIG. 1, an example apparatus 10 is shown comprising a cabinet 12 defining an enclosure 14. The apparatus 10 in the present example is an appliance and, more specifically, a refrigerator with a fresh-food compartment and a top-mount freezer compartment, the enclosure 14 being the fresh-food compartment. However, in some embodiments, the apparatus 10 is a refrigerator with an alternative arrangement of compartments or a refrigerator with a single compartment. The apparatus 10 can be any cabinet-like structure that comprises a cabinet defining an enclosure. The refrigerator 10 can have a refrigeration system that maintains the fresh-food compartment at temperatures above 0° C. and the freezer compartment at temperatures below 0° C. The fresh-food compartment can store food items such as fruits, vegetables, and beverages and the freezer compartment can store food items that are to be kept in a frozen condition.

The arrangement of the fresh-food compartment and the freezer compartment with respect to one another in such refrigerators vary. For example, in some cases, the freezer compartment is located above the fresh-food compartment (i.e., a top mount refrigerator), and in other cases the freezer compartment is located below the fresh-food compartment (i.e. a bottom mount refrigerator). Many modern refrigerators have their freezer compartments and fresh-food compartments arranged in a side-by-side relationship. Additionally, some refrigeration appliances have either a fresh-food compartment only or a freezer compartment only. A door 16 provides access to one or more of the compartments. As shown in FIG. 1, the door 16 provides access to the fresh-food compartment 14. The door 16 is pivotally coupled to the cabinet 12 of the refrigerator 10 to restrict and grant access to the fresh-food compartment 14. While the present application is described herein by way of an example as a top-mount refrigerator with a freezer compartment located above the fresh-food compartment and closed by another door, it is contemplated that other refrigerator configurations can be used, such as refrigerators that only feature a fresh food compartment, bottom-mount refrigerators (fresh food compartment on top, freezer on bottom) having at least one door, side-by-side refrigerators, etc.

A storage system 20 is configured to be mounted to an inner panel 22 of the door 16 of the refrigerator 10. The storage system 20 is configured to enable selective horizontal sliding or placement of at least one storage bin, referred to herein as a harvest bin assembly 50, along a continuum of locations on a rail 24 mounted on the door 16. FIG. 1 shows a number of rails 24 at various elevations of the door 16. It is contemplated that the door 16 may include one rail 24 and a plurality of shelves (not shown). The storage system 20 is described in greater detail in U.S. Patent Application Publication No. 2014/0360220, hereby fully incorporated herein by reference.

Figure 5:
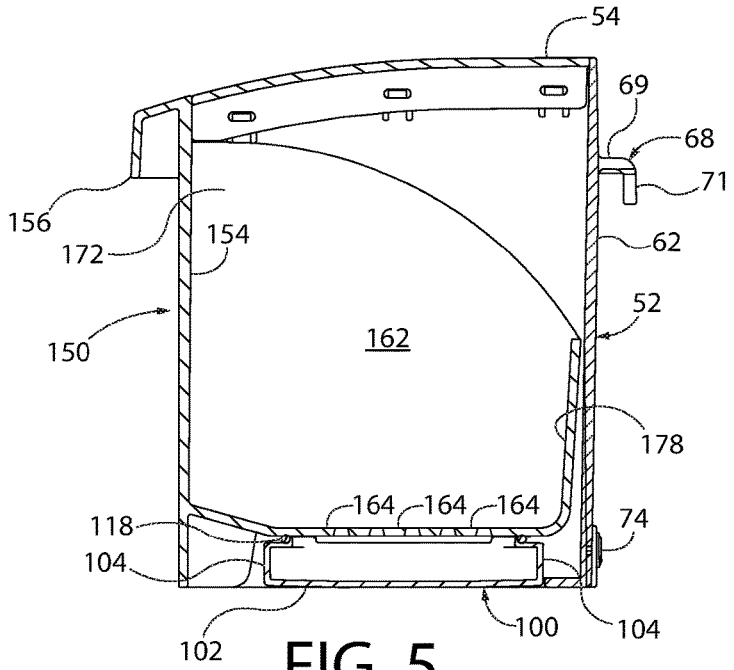
FIG. 5 is a sectional view of the harvest bin assembly shown in FIG. 4.
Figure 6:
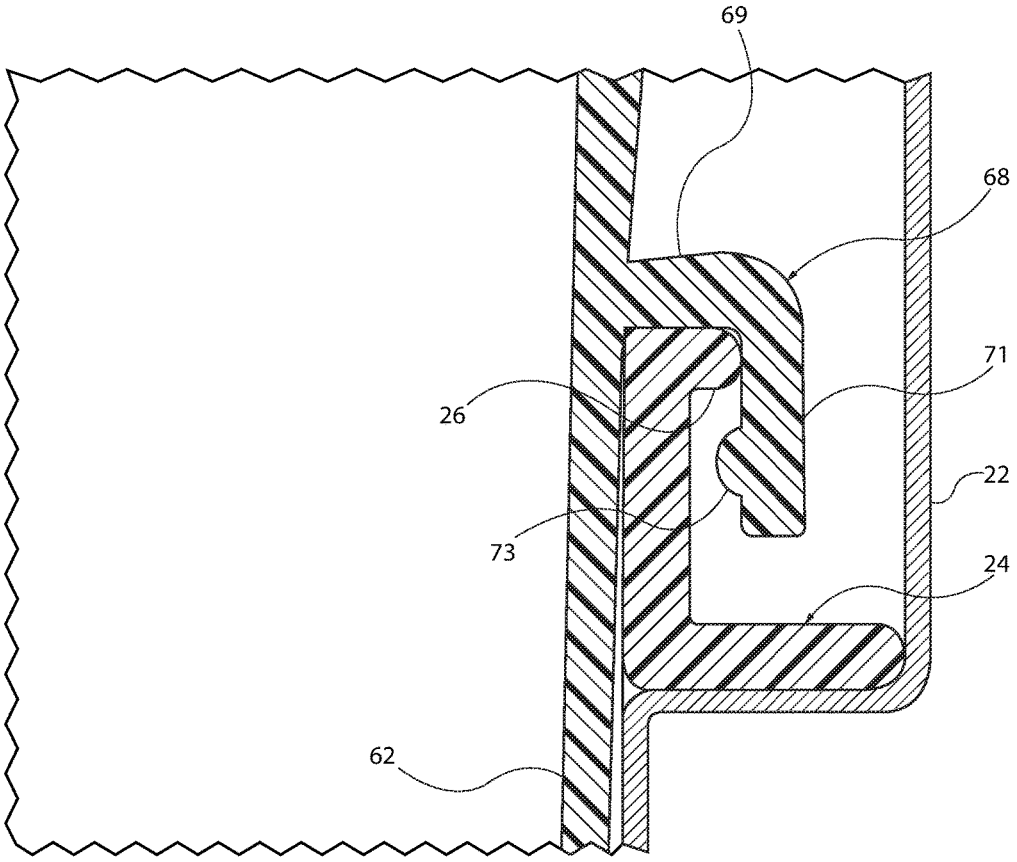
FIG. 6 is a sectional view of a mount for the harvest bin assembly shown in FIG. 2 attached to a rail on the door of the refrigerator.

Referring now to FIGS. 2-5, one example harvest bin assembly 50 is shown. The harvest bin assembly 50 includes a housing 52, a drip tray 100 and a removable bin 150. Referring now to FIG. 6, the housing 52 is generally rectangular-in-shape and includes a top 54, opposing sides 56, 58, and a back 62. The top 54 and the opposing sides 56, 58 define a front opening 64 of the housing 52 and the back 62 and the opposing sides 56, 58 define a bottom opening 66 of the housing 52. Of course, the housing 52 and harvest bin assembly 50 overall can feature various other geometries.

Figure 3:
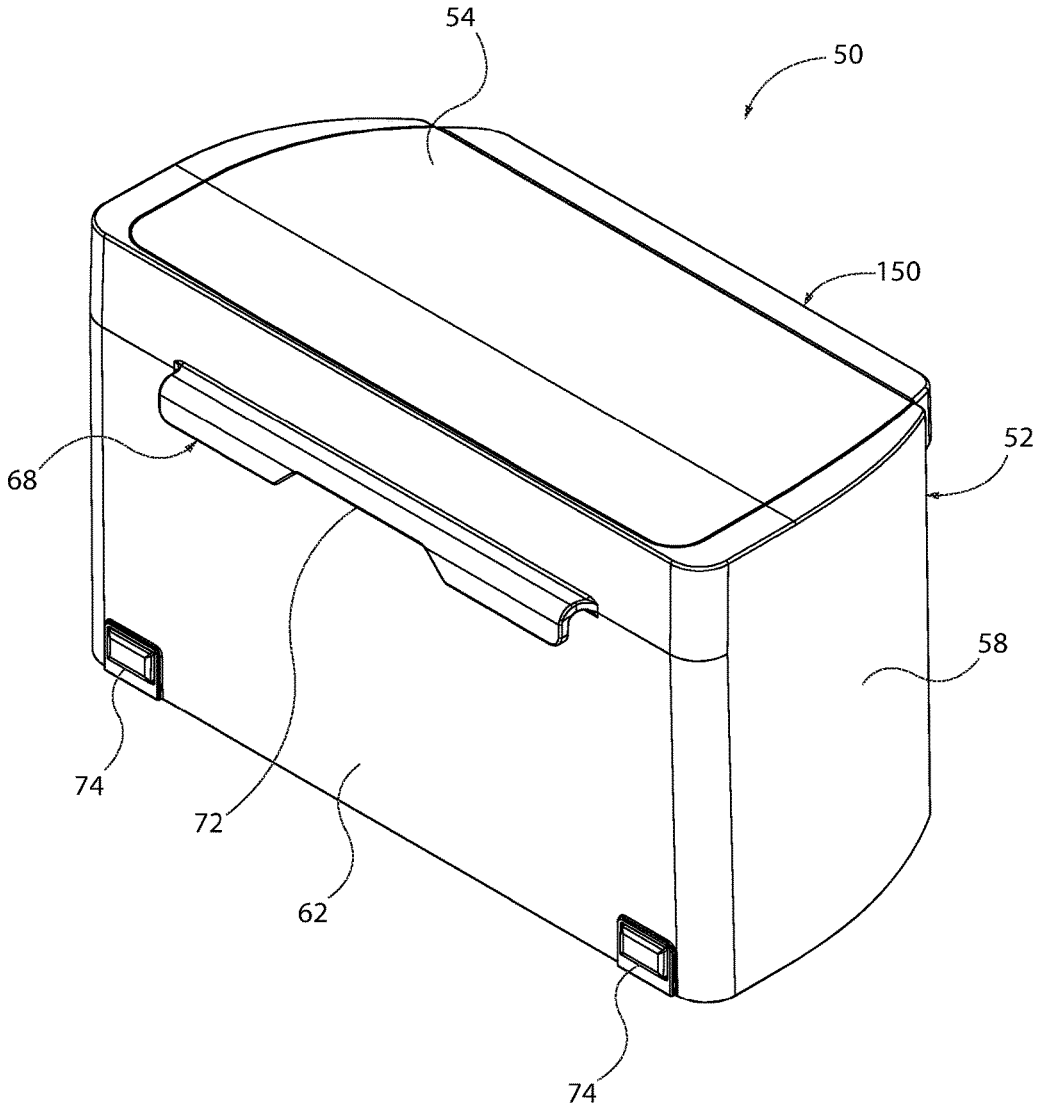
FIG. 3 is a rear perspective view of the harvest bin assembly shown in FIG. 2.
Figure 4:
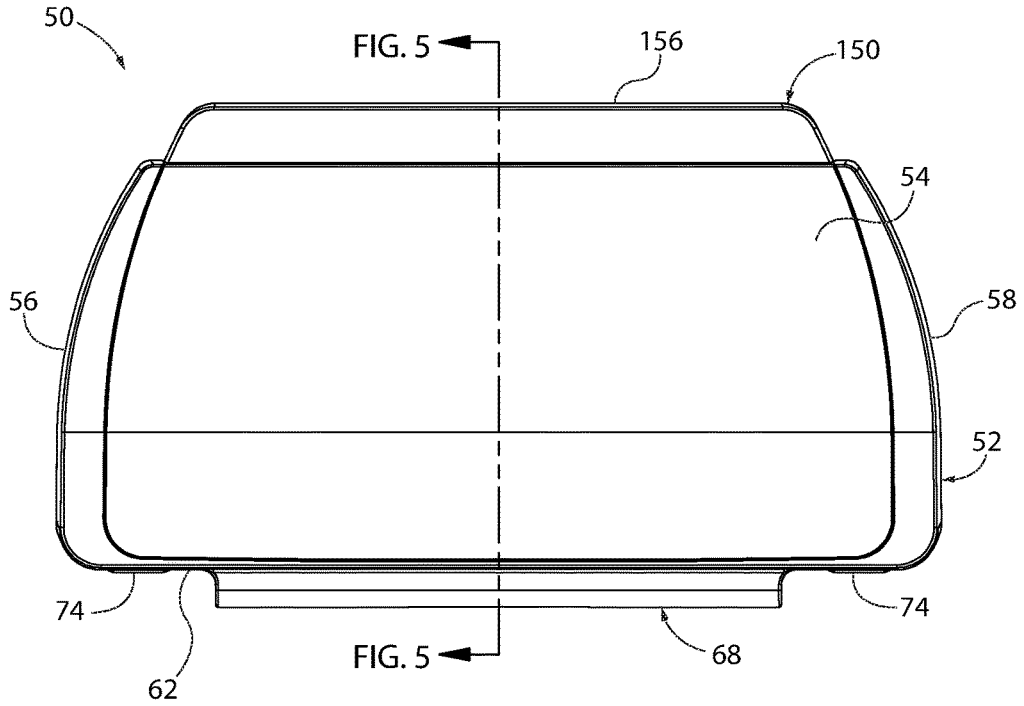
FIG. 4 is a top plane view of the harvest bin assembly shown in FIG. 2.

Referring now to FIG. 3, the housing 52 includes at least one pad 74 extending outwardly from the back 62 of the housing 52. The pad 74 contacts the inner panel 22 of the door 16 when the harvest bin assembly 50 is placed onto the rail 24 on the door 16. The pad 74 provides friction between the housing 52 and the inner panel 22 of the door 16 to help limit side to side movement of the harvest bin assembly 50, as will be described below. The pad 74 may also act as a spacer to facilitate a level (i.e., horizontal) orientation of the harvest bin assembly 50 when mounted on the refrigerator door. It is to be appreciated that the pad 74 can be made of plastic, rubber, glass, wire, or any other suitable rigid material such as a polystyrene composition. In another example, the pad 74 and the back 62 of the housing are molded together such that the pad 74 and the back 62 are constructed of one unitary piece.

A mount 68 extends from the back 62 of the housing 52. The mount 68 can be of any suitable shape or orientation including planar configurations, arcuate configurations such as a hook, etc. In the embodiment shown, the mount 68 includes a substantially horizontal first arm portion 69 extending from the back 62. While the first arm portion 69 is shown extending from the rear surface of the back 62 at the upper portion of the back 62, it is contemplated that the first arm portion 69 can be placed at any suitable location. The mount 68 also includes a substantially vertical second arm portion 71 extending downwardly from the first arm portion 69. The second arm portion 71 is configured to be placed between the rail 24 and the inner panel 22 of the door 16 (best seen in FIG. 6) when the housing 52 is placed on the door 16. The second arm portion 71 can further include a substantially horizontal protrusion 73 on a front-facing surface of the second arm portion 71. In the embodiment shown in FIG. 3, a notch 72 is formed in a central portion of the mount 68.

Referring again to FIG. 6, a cross-sectional view of the mount 68 of the housing 52 interacting with the rail 24 is shown. The housing 52 is attached to the door 16 such that the second arm portion 71 is placed between the rail 24 and the inner panel 22 of the door 16. In one example, a protrusion 26 on the rail 24 and the protrusion 73 on the mount 68 are configured to interact with each other. A distal end of the protrusion 26 is relatively close to and/or contacts the front-facing surface of the second arm portion 71.

The proximity between the protrusion 26 on the rail 24 and the protrusion 73 on the mount 68 creates a physical interference when the housing 52 is placed in or removed from the rail 24 on the door 16. The physical interference helps prevent unintentional removal of the housing 52 from engagement with the rail 24. This physical interference can be overcome by application of a relatively small amount of force placed upon the housing 52. When the housing 52 is attached to the rail 24, an adequate amount of force in the upward direction will elastically deform one or both of the first arm portion 69 and the second arm portion 71 such that the protrusion 26 and the protrusion 73 pass each other. This enables the housing 52 to be removed from engagement with the rail 24, after which the first arm portion 69 and the second arm portion 71 return to their original shape/position. Similarly, engagement of the housing 52 with the rail 24 requires an adequate amount of downward force to elastically deform one or both of the first arm portion 69 and the second arm portion 71 such that the protrusion 26 and the protrusion 73 pass each other. After the protrusion 26 and the protrusion 73 pass each other, the first arm portion 69 and the second arm portion 71 return to their original shape/position and the second arm portion 71 is located between the rail 24 and the inner panel 22 of the door 16.

Additionally, a bottom surface of the first arm portion 69 contacts the top edge of the rail 24. This contact creates a friction force that can overcome a tendency of the housing 52 to slide from side-to-side when the door 16 is opened and closed. In one example, the materials of the first arm portion 69 of the mount 68 and the top edge of the rail 24 can be selected to give rise to a particular desired coefficient of static friction between the housing 52 and the rail 24. Optionally, an additive material, such as rubber or other relatively high friction material, can be added to either or both of the first arm portion 69 and the top edge of the rail 24 to further reduce unintentional sliding of the housing 52. The housing 52 can be constructed of polystyrene and the rail 24 can be constructed of ABS plastic. As shown in FIG. 6, contact can optionally be maintained between the housing 52 and the rail 24 in other locations as well.

Figure 7:
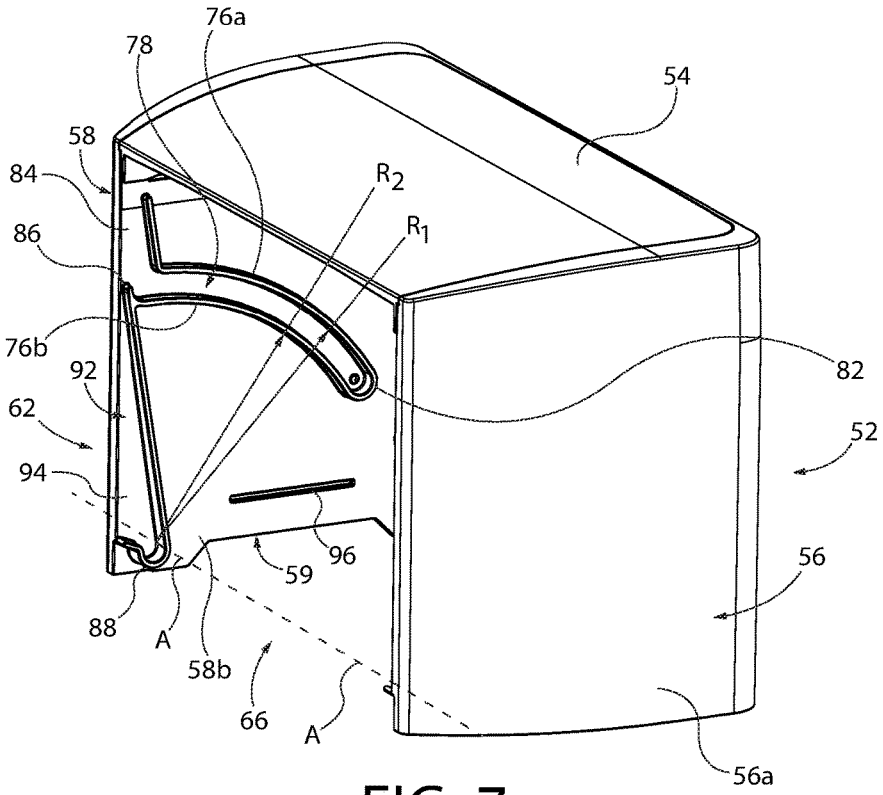
FIG. 7 is a front perspective view of a housing of the harvest bin assembly shown in FIG. 2.

Referring now to FIG. 7, opposing sides 56, 58 of the housing 52 are essentially mirror images of each other and only side 58 will be described in detail. Side 58 includes an outer wall 58*a* and an inner wall 58*b* that is spaced from the outer wall 58*a*. The inner wall 58*b* includes a notch 59 formed in a lower end thereof. In the embodiment shown, the outer wall 58*a* is curved to provide an aesthetically pleasing contour for a user.

An upper flange 76*a* and a lower flange 76*b* extend from the inner surface of the inner wall 58*b*. The upper flange 76*a* and the lower flange 76*b* are generally arcuate in shape and are spaced from each other to define a guide slot or channel 78 therebetween. The ends of the upper flange 76*a* and the lower flange 76*b* are disposed toward the back 62 of the housing 52 are connected to define a closed end 82 of the guide slot or channel 78. The upper flange 76*a* extends in an upward direction away from the lower flange 76*b* near the front opening 64 of the housing 52 to define an enlarged receiving opening 84 of the guide slot or channel 78. The lower flange 76*b* includes an upward turned lip 86 near the front opening 64 of the housing 52. The upward turned lip 86 is positioned and dimensioned as described in detail below. The upper flange 76*a* is generally arcuate in shape with a radius $R_1$ and the lower flange 76*b* is generally arcuate in shape with a radius $R_2$ with respect to a pivot axis A of the housing 52 to maintain a generally constant width of the guide slot or channel 78, as described in detail below.

A generally J-shaped flange 88 extends from the inner surface of the inner wall 58*b* at a location below the guide slot or channel 78. The J-shaped flange 88 defines a pivot slot or receiver 92 for receiving a pivot pin 174, described in detail below. A lower portion of the J-shaped flange 88 is curved to define the pivot axis A of the housing 52. The leg of the J-shaped flange 88 extends in an upward direction and has an end that connects to the upward turned lip 86 of the lower flange 76*b* of the guide slot or channel 78. The J-shaped flange 88 defines an enlarged receiving opening 94 of the pivot slot or receiver 92 that is oriented toward the front opening 64 of the housing 52 for receiving the pivot pin 174, described in detail below.

In the embodiment shown, the guide slot or channel 78 and the pivot slot or receiver 92 are defined by flanges 76*a*, 76*b*, 88, respectively, that extend from the inner wall 58*b*. It is contemplated that one or both of the guide slot or channel 78 and the pivot slot or receiver 92 may be formed as grooves that extend into the surface of the inner wall 58*b*. It is also contemplated that the guide slot or channel 78 may also be a track that is defined by at least one flange extending from the inner wall 58*b*.

An elongated groove 96 extends along a lower portion of the inner wall 58*b* of the side 58. The elongated groove 96 is dimensioned and positioned to mate with the drip tray 100, described in detail below. In the embodiment shown, the groove 96 is generally parallel to a bottom edge of the inner wall 58*b* and is located above the notch 59. However, it is contemplated that the groove 96 may have any other orientation so long as a mating element of the drip tray 100 engages the housing 52. In the embodiment shown, the groove 96 is formed in the inner wall 58*b* such that the drip tray 100 is received between the sides 56, 58. It is contemplated that the groove 96 could be formed in the outer wall 58*a* such that the drip tray 100 attaches to the outer walls 56*a*, 58*a* of the housing 52. It is also contemplated that instead of a groove an elongated protrusion may be formed on the inner wall 58*b*. In this embodiment, the mating element of the drip tray 100 would snap over the elongated protrusion.

It is contemplated that the housing 52 may be made as one unitary member or two or more components that are joined together. As shown in FIG. 5, the top 54 of the housing 52 may include a separate component, e.g., a top, that is attached by fasteners or locking tabs to the opposing sides 56, 58 and back 62 of the housing 52. In one example, the top 54 could be selectively removable or pivotable by the user.

Figure 8:
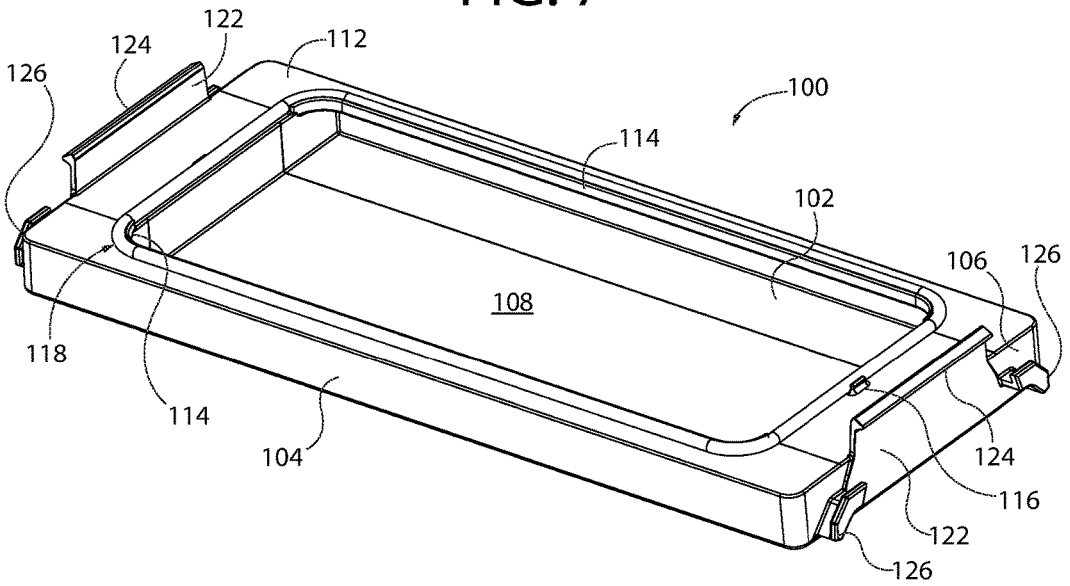
FIG. 8 is a front perspective view of a drip tray of the harvest bin assembly shown in FIG. 2.

As seen in FIG. 5, the drip tray 100 is attached to a bottom of the housing 52. In the embodiment shown, the drip tray 100 is removable from the housing 52, however, it is contemplated that the drip tray 100 may also be integrally formed into the housing 52. Referring now to FIG. 8, the drip tray 100 has a geometry that corresponds to that of the housing 52, and in this example is a generally rectangular box-shaped element with a rectangular bottom 102 acting as a trough, two opposing long sides 104 and two opposing short sides 106. An opening 108 is formed in a top wall 112 of the drip tray 100. In the embodiment shown, the opening 108 is generally rectangular in shape, although various profiles are contemplated. Two long flanges 114 extend along the long edge of the opening 108 and two tabs 116 are spaced from the short edge of the opening 108. The flanges 114 and tabs 116 are positioned and dimensioned to locate an o-ring 118 about the periphery of the opening 108. It is contemplated that, instead of the o-ring 118, one or more gaskets may be positioned on the top wall 112 of the drip tray 100. In another embodiment, a sealing flange (not show) may be formed around the peripheral edge of the opening 108 and be positioned and dimensioned to seal with the removable bin 150 when the removable bin 150 is inserted into the housing 52, as described in detail below. It is further contemplated that the flanges and o-ring, as illustrated, could instead be combined as an integrally molded element of the drip tray 100 to simplify manufacturing. Such an integrally molded element could optionally include a labyrinth or other mechanical mating structure to encourage a seal with the removable bin 150.

Mounting tabs 122 are positioned on the opposing short sides 106 of the drip tray 100 for attaching the drip tray 100 to the housing 52. A V-shape flange 124 extends in an outward direction from each mounting tab 122. The flanges 124 are dimensioned and positioned to engage in a snap-fit manner with the corresponding groove 96 formed in the housing 52. The mounting tabs 122 are designed to flex inwardly such that when the drip tray 100 is attached to the housing 52 the flanges 124 can be withdrawn from the grooves 96 thereby allowing the drip tray 100 to be removed from the housing 52. The drip tray 100 also includes a grooved foot 126 at an end of each mounting tab 122 as an alignment structure for mating with the notch 59 in the lower portion of the inner wall 58*b* of the housing 52. When the drip tray 100 is positioned within the housing 52, the drip tray 100 defines a bottom of the harvest bin assembly 50, as shown in FIG. 5.

Referring now to FIGS. 2, 5, 9 and 10, the removable bin 150 is dimensioned to be received into the housing 52 of the harvest bin assembly 50 and to pivot relative to the housing 52. The removable bin 150 is a generally rectangular box-shaped element with a bottom wall 152, a front wall 154, opposing side walls 172 and a back wall 178 that together define a storage area 162 of the removable bin 150. A plurality of holes 164 are formed in a portion 152*a* of the bottom wall 152. The plurality of holes 164 are dimensioned and position to allow water to pass therethrough by gravity while retaining food items, such as fruits and vegetables within the storage area 162 of the removable bin 150. As a result, residual water that remains on the food items will drain into the drip tray 100 so that the food items are not stored immersed in water. Additionally, the drained water that remains within the trough of the drip tray 100 may provide humidity to the food items stored within the harvest bin assembly 50 to increase freshness. A front portion 152*b* of the bottom wall 152 is sloped toward the portion 152*a* wherein the plurality of holes 164 is disposed. As such, when the removable bin 150 is in a first, closed position, described in detail below, the portion 152*a* of the bottom wall 152 is substantially horizontal and the front portion 152*b* slopes downwardly toward the portion 152*a*. As such, water on the front portion 152*b* is directed toward the plurality of holes 164 in the portion 152*a* of the bottom wall 152. Although not shown, it is contemplated that a rear portion and/or side portions of the bottom wall 152 may similarly be sloped downward in a manner similar to portion 152*a*.

The front wall 154 of the removable bin 150 extends upwardly from one side of the bottom wall 152. The outer surface of the front wall 154 is contoured to define a handle portion 156 at an upper end thereof. The handle portion 156 is positioned and dimensioned to allow the fingers of a user to easily grip and manipulate the removable bin 150, as described in detail below.

Figure 9:
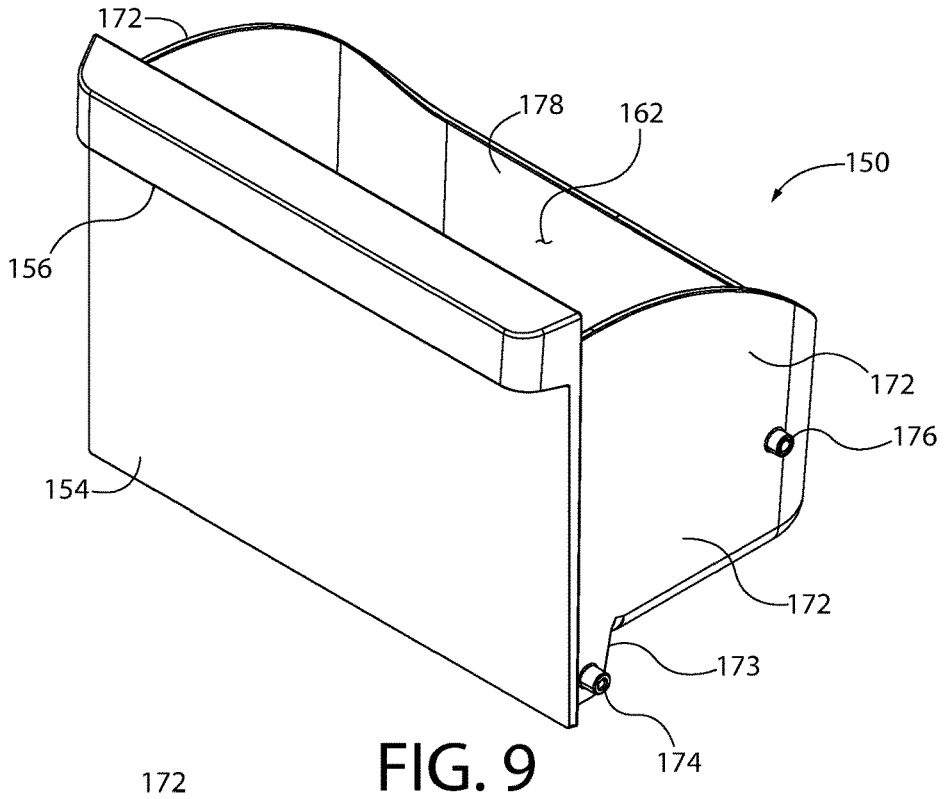
FIG. 9 is a front perspective view of a removable bin of the harvest bin assembly shown in FIG. 2.
Figure 10:
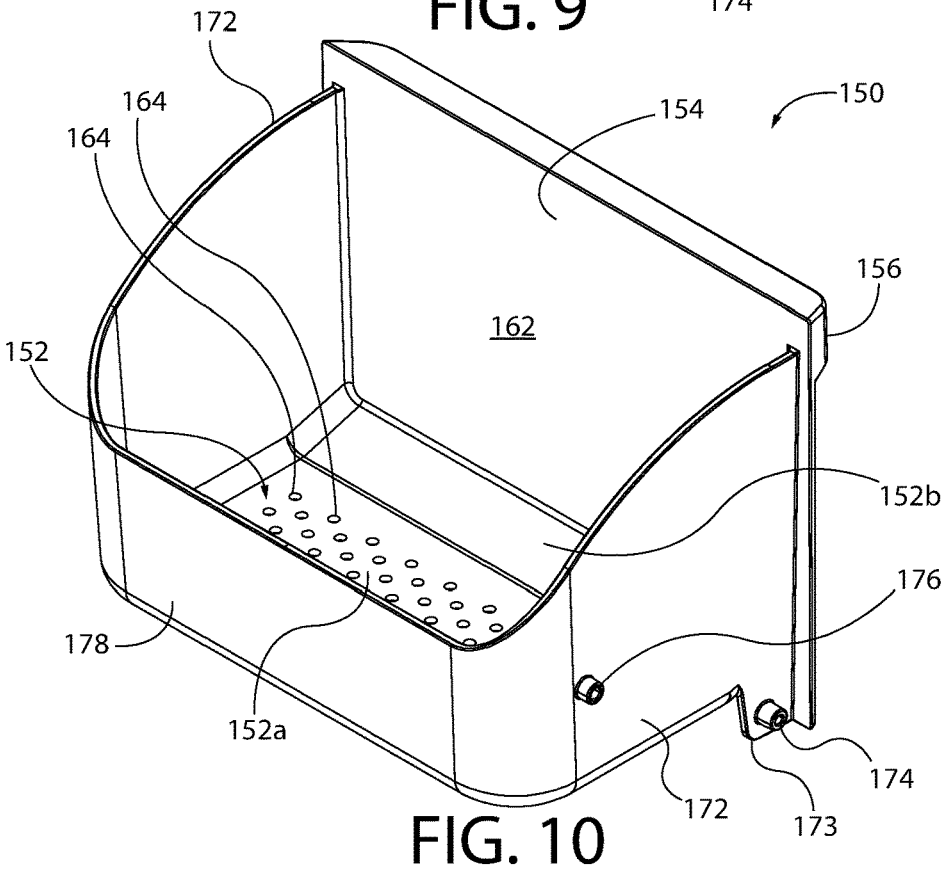
FIG. 10 is a rear perspective view of the removable bin shown in FIG. 9.

The opposing side walls 172 extend upwardly from opposite sides of the bottom wall 152. As shown in FIGS. 5, 9 and 10, a top edge of each opposing side wall 172 curves downwardly toward the back wall 178 of the removable bin 150. Each side wall 172 includes a tab portion 173 extending from a lower end of the side wall 172 near the front wall 154. A pivot pin 174 extends outwardly from each tab portion 173. The pivot pins 174 are positioned and dimensioned to be received into the pivot slot or receiver 92 in the housing 52 when the removable bin 150 is placed into the housing 52, as described in detail below. A guide pin 176 extends outwardly from each side wall 172 near the back wall 178. The guide pins 176 are positioned and dimensioned to slide within the guide slot or channel 78 when the removable bin 150 is placed in the housing 52, as described in detail below. The pivot pin 174 and the guide pin 176 can be integrally molded with the side wall 172, or can be otherwise coupled thereto via fasteners, adhesives, welding, etc. The pivot pin 174 and the guide pin 176 could be non-rotational or rotational elements.

In the embodiment shown, the pivot pin 174 and the guide pin 176 are generally cylindrical-shaped elements that pivot and slide within the pivot slot or receiver 92 and the guide slot or channel 78, respectively. It is also contemplated that one or both of the pivot pin 174 and the guide pin 176 may extend from (molded with or otherwise attached to) the inner wall 56*b*, 58*b* of the sides 56, 58 of the housing 52 instead of from the removable bin 150. Similarly, the mating pivot slot or receiver 92 and the guide slot or channel 78, respectively, may be formed in the sides 172 of the removable bin 150 instead of the housing 52. Moreover, as noted above, the guide slot or channel 78 and the pivot slot or receiver 92 are described above as being defined by flanges 76*a*, 76*b*, 88, respectively, but it is also contemplated that they may be formed as grooves that extend into the surface of the sides 172 of the removable bin 150 or at least one flange that extends from the surface of the sides 172 of the removable bin 150.

It is contemplated that the opposing side walls 172 may include elongated openings (not shown) formed therein. The openings are positioned and dimensioned to define handles for allowing a user to easily grip and carry the removable bin 150.

The back wall 178 extends upwardly from the bottom wall 152 between the opposing side walls 172. In the embodiment shown, the edges of the back wall 178 and the side walls 172 are curved to provide an aesthetically pleasing shape.

In the embodiment shown, the front wall 154 of the removable bin 150 is opaque. However, it is contemplated that the front wall 154 of the removable bin 150, and/or any portion of the housing 52 (e.g., the top), may be translucent or transparent such that the contents of the storage area 162 can be seen by a user. The dimensions of the storage area 162 can vary as one skilled in the art would recognize, for example to accommodate various food items. As shown, the storage area 162 has one compartment, but it is also contemplated that removable or non-removable dividers or walls (not shown) may be placed in the storage area 162 to divide the storage area 162 into two or more compartments so that different food items can be separately stored in each compartment of the removable bin 150.

The removable bin 150 is positioned within the housing 52 by placing the pivot pin 174 of the removable bin 150 into the detent formed by the pivot slot or receiver 92 while simultaneously placing the guide pin 176 of the removable bin 150 into the receiving opening 84 of the guide slot or channel 78. The detent formed by the pivot slot or receiver 92 defines the pivot axis A for allowing the removable bin 150 to pivot relative to the housing 52. In this respect, the pivot slots or receivers 92 act as "first pivot elements" and the pivot pins 174 act as "second pivot elements" that together define a pivot axis of the harvest bin assembly 50.

Figure 11:
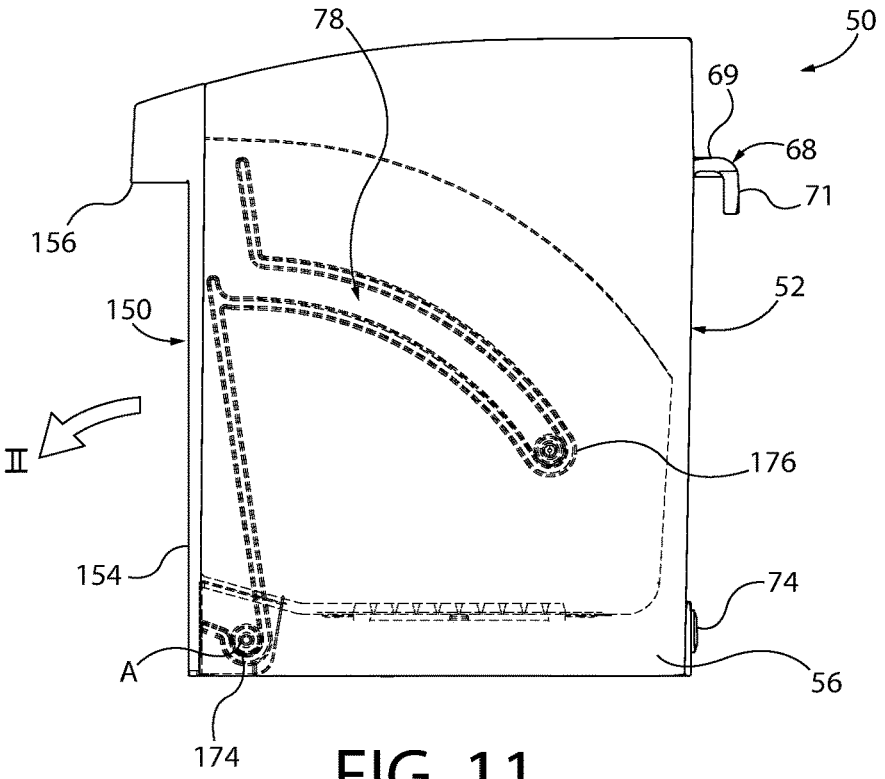
FIG. 11 is a side plane view showing the removable bin of the harvest bin assembly in a first, closed position.
Figure 12:
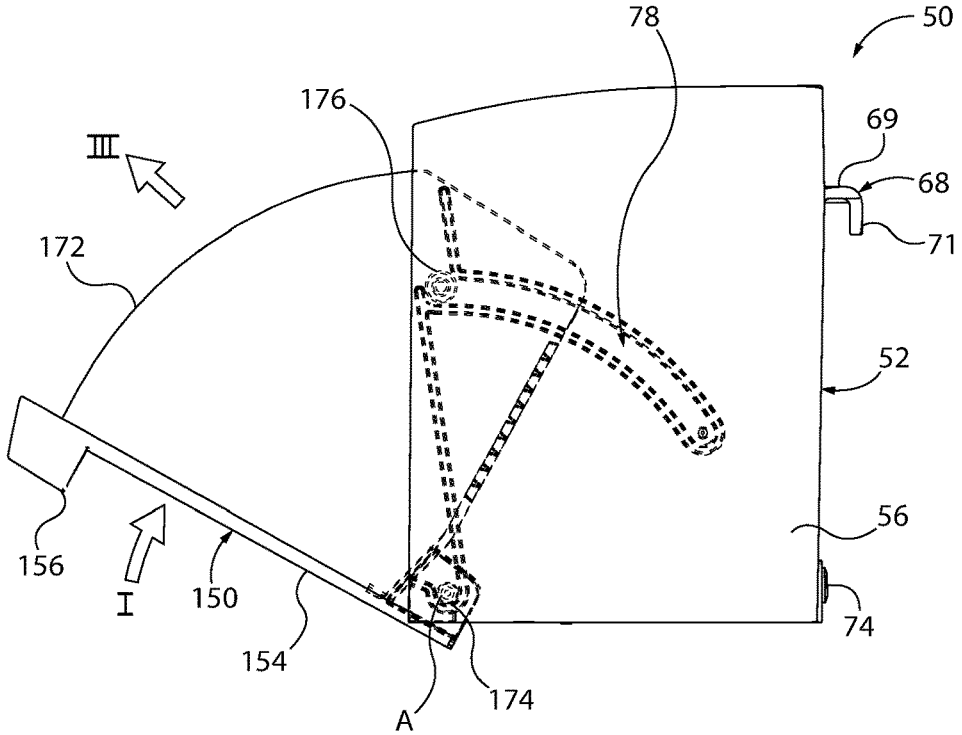
FIG. 12 is a side plane view showing the removable bin of the harvest bin assembly pivoted to a second, open position.

Referring to FIG. 12, the removable bin 150 is shown in a second, open position. As the removable bin 150 pivots into the housing 52 in the clockwise direction "I" (when viewed as shown in FIG. 12), the guide pin 176 slides along the guide slot or channel 78 until the removable bin 150 is fully seated into the housing 52. The removable bin 150 is then in the first, closed position. In this respect, the guide slots or channels 78 act as "guide channels" and the guide pins 176 act as "guide elements" that together guide the removable bin 150 as the removable bin 150 pivots. In this first, closed position of the removable bin 150 (shown in FIG. 11), the upper portion of the front wall 154 of the removable bin 150 contacts the leading edge of the top 54 of the housing 52. Moreover, as shown in FIG. 5, the bottom wall 152 of the removable bin 150 contacts the o-ring 118 on the drip tray 100. In this respect, the o-ring 118 acts as a "sealing element" between the removable bin 150 and the drip tray 100. As such, the storage area 162 of the removable bin 150 is fluidly isolated from the surrounding environment of the refrigerator 10. The storage area 162 thus may be maintained at a humidity level that is different than the humidity level in the enclosure 14 of the refrigerator 10, if desired. In addition, the plurality of holes 164 in the bottom wall 152 of the removable bin 150 is positioned to align with the opening 108 of the drip tray 100. As such, residual water in the removable bin 150 may fall and collect in the drip tray 100. The water, thus, does not remain in contact with the food items stored in the storage area 162 of the removable bin 150.

Figure 13:
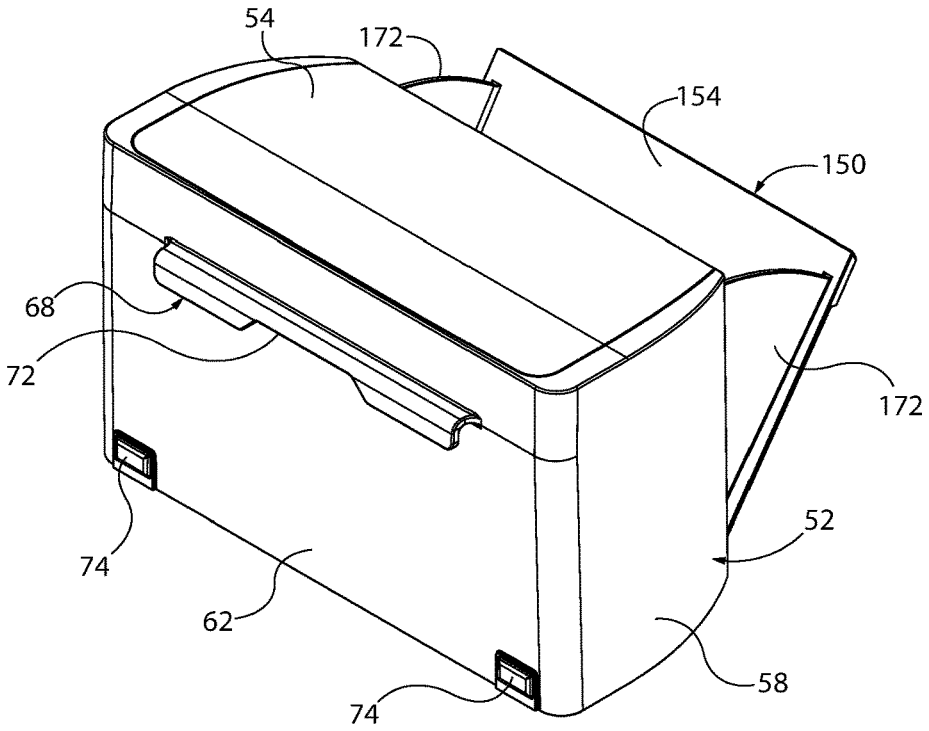
FIG. 13 is a rear perspective view showing the removable bin of the harvest bin assembly in an intermediate position.
Figure 14:
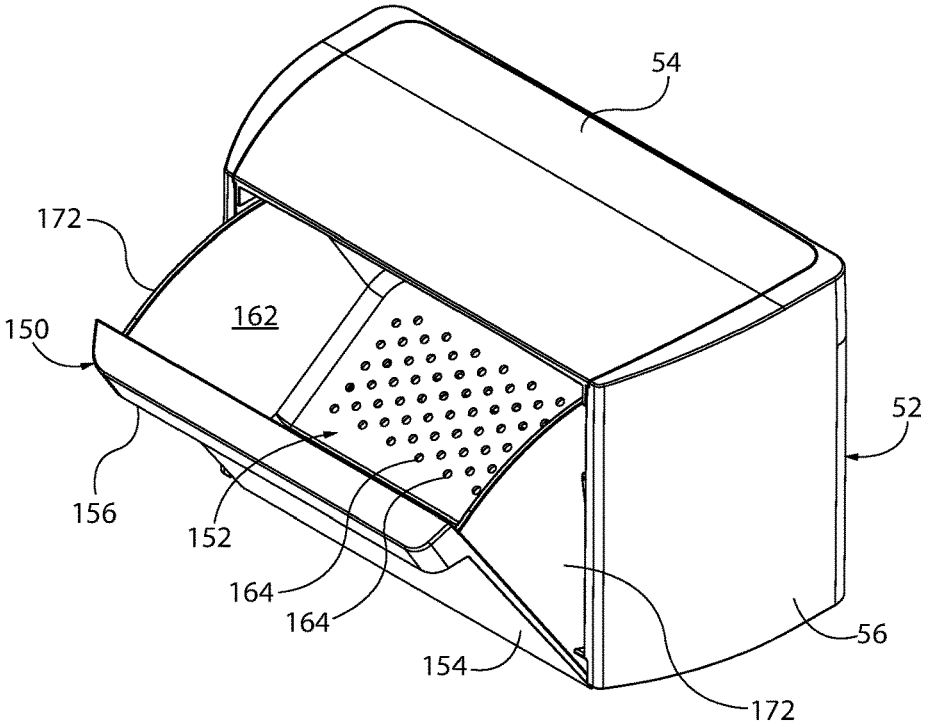
FIG. 14 is a front perspective view showing the removable bin of the harvest bin assembly in the intermediate position.

The removal of the removable bin 150 occurs in the reverse order described above. In particular, the removable bin 150 pivots in the counterclockwise direction "II" (when viewed as shown in FIGS. 11 and 12). The removable bin 150 pivots until the guide pin 176 contacts the upward turned lip 86 of the guide slot or channel 78. When in this position, as shown in FIG. 12, a user may lift the removable bin 150 out of the housing 52 in the direction "III." FIGS. 13 and 14 illustrate back and front views, respectively, of the removable bin 150 in an intermediate position between the first, closed position and the second, open position. In order to facilitate removal and insertion of the removable bin 150, the enlarged receiving opening 84 and the lip 86 for the guide pin 176 can be substantially in vertical alignment with the flange 88 for the pivot pin 174. Thus, movement of the removable bin 150 in the vertical direction will insert or release both of the pivot pin 174 and the guide pin 176 at about the same time.

As noted above, the bottom wall 152 of the removable bin 150 includes a plurality of holes 164. As such, when the removable bin 150 is removed from the housing 52, the removable bin 150 may function as a colander for allowing a user to rinse food items in a kitchen sink or the like. The removable bin 150 may then be reinserted into the housing 52, in the manner described in detail above.

It will be apparent to those skilled in the art that various modifications and variations can be made without departing from the spirit and scope of the claimed invention. Example embodiments incorporating one or more aspects of the invention are intended to include all such modifications and alterations insofar as they come within the scope of the appended claims.

What is claimed is:

1. A refrigerator appliance comprising:

a compartment within the refrigeration appliance for storing food items in a refrigerated environment;

a door movable between an open position for allowing access to the compartment and a closed position for sealing the compartment, the door including an interior wall; and a harvest bin assembly attachable to the door, the harvest bin assembly for storing food items therein and including:

a housing comprising opposing sides walls, a first pivot element on each side of the housing, each first pivot element having a receiving opening, at least one of a guide element or a guide channel in one of the opposing side walls of the housing, the guide channel having a receiving opening oriented toward a front opening of the housing, and a lower wall formed to define a cavity and an opening that extends through a top surface of the lower wall and fluidly communicates with the cavity, wherein the lower wall is detachable from the housing, and a removable bin comprising:

a front wall, a back wall, opposing side walls and a bottom wall defining a storage space, a plurality of holes formed in the bottom wall for allowing water to pass therethrough but hindering the food items from passing therethrough, a second pivot element on each opposing side wall of the removable bin wherein each second pivot element engages a corresponding first pivot element on the housing when the removable bin is positioned within the housing, and the other of the at least one of the guide element or the guide channel in one of the opposing side walls of the removable bin, wherein the first pivot elements and the second pivot elements define a pivot axis whereby the removable bin pivots between a first, closed position and a second, open position relative to the housing, wherein the receiving opening of the guide channel is dimensioned to receive the guide element and the receiving opening of the first pivot element is dimensioned to receive the second pivot element when the removable bin is inserted into the housing, and wherein the guide element and the guide channel are configured to guide the removable bin as the removable bin pivots between the first, closed position and the second, open position.

2. The refrigerator appliance of claim 1, wherein the guide channel is a curved channel formed by at least one rail extending outwardly from one of the opposing side walls of the housing or one of the opposing side walls of the removable bin.

3. The refrigerator appliance of claim 1, wherein the guide channel is a curved slot formed by at least one rail extending outwardly from one of the opposing side walls of the housing or one of the opposing side walls of the removable bin.

4. The refrigerator appliance of claim 1, wherein the first pivot element includes a leg that extends to a wall of the guide channel.

5. The refrigerator appliance of claim 1, wherein the receiving opening of the guide channel is defined by an upward extending flange.

6. The refrigerator appliance of claim 1, wherein the harvest bin assembly is removably mounted to the door.

7. The refrigerator appliance of claim 1, wherein the front wall of the removable bin is transparent.

8. A refrigerator appliance comprising:

a compartment within the refrigeration appliance for storing food items in a refrigerated environment;

a door movable between an open position for allowing access to the compartment and a closed position for sealing the compartment, the door including an interior wall; and a harvest bin assembly attachable to the interior wall, the harvest bin assembly for storing food items therein and including:

a housing comprising:

opposing side walls, a first pivot element on each opposing side wall of the housing, and a lower wall of the housing formed to define a cavity and an opening that extends through a top surface of the lower wall and fluidly communicates with the cavity, wherein the lower wall is detachable from the housing, and a removable bin comprising:

a front wall, a back wall, opposing side walls and a bottom wall defining a storage space, a plurality of holes formed in the bottom wall for allowing water to pass therethrough but hindering the food items from passing therethrough, and a second pivot element on each opposing side wall of the removable bin wherein each second pivot element engages a corresponding first pivot element on the housing when the removable bin is positioned within the housing, wherein the first pivot elements and the second pivot elements define a pivot axis whereby the removable bin pivots between a first, closed position and a second, open position relative to the housing, wherein the top surface of the lower wall is positioned adjacent the bottom wall of the removable bin and the opening in the lower wall is in registry with the plurality of holes of the removable bin when the removable bin is in the first, closed position.

9. The refrigerator appliance of claim 8, further comprising a sealing element disposed between the bottom wall of the removable bin and the lower wall of the housing when the removable bin is in the first, closed position for forming a seal between the removable bin and the lower wall.

10. The refrigerator appliance of claim 9, wherein the sealing element extends around an outer periphery of the opening formed in the lower wall.

11. The refrigerator appliance of claim 8, wherein the harvest bin assembly is removably mounted to the door.

12. The refrigerator appliance of claim 8, wherein the front wall of the removable bin is transparent.

13. A harvest bin assembly for a refrigerator door, the harvest bin assembly for storing food items therein and including:

a housing comprising opposing side walls, a first pivot element on each side of the housing, each first pivot element having a receiving opening, at least one of a guide element or a guide channel in one of the opposing side walls of the housing, the guide channel having a receiving opening oriented toward a front opening of the housing, and a lower wall formed to define a cavity and an opening that extends through a top surface of the lower wall and fluidly communicates with the cavity, wherein the lower wall is detachable from the housing, and a removable bin comprising:

a front wall, a back wall, opposing side walls and a bottom wall defining a storage space, a plurality of holes formed in the bottom wall for allowing water to pass therethrough but hindering the food items from passing therethrough, a second pivot element on each opposing side wall of the removable bin wherein each second pivot element engages a corresponding first pivot element on the housing when the removable bin is positioned within the housing, and the other of the guide element or the guide channel in one of the opposing side walls of the removable bin, wherein the first pivot elements and the second pivot elements define a pivot axis whereby the removable bin pivots between a first, closed position and a second, open position relative to the housing, wherein the receiving opening of the guide channel is dimensioned to receive the guide element and the receiving opening of the first pivot element is dimensioned to receive the second pivot element when the removable bin is inserted into the housing, and wherein the guide element and the guide channel guide the removable bin as the removable bin pivots between the first, closed position and the second, open position.

14. The harvest bin assembly of claim 13, wherein the top surface of the lower wall of the housing is positioned adjacent the bottom wall of the removable bin and the opening in the lower wall is in registry with the plurality of holes of the removable bin when the removable bin is in the first, closed position.

15. The harvest bin assembly of claim 14, further comprising a sealing element disposed between the bottom wall of the removable bin and the lower wall of the housing when the removable bin is in the first, closed position for forming a seal between the removable bin and the lower wall, wherein the sealing element extends around an outer periphery of the opening formed in the lower wall.

16. The harvest bin assembly of claim 13, wherein the housing is removably mounted to a refrigerator door.

17. The harvest bin assembly of claim 13, wherein the front wall of the removable bin is transparent.

18. The harvest bin assembly of claim 13, wherein the housing is detachable from an interior wall of the refrigerator door.

* * * * *